United States Patent [19]

Miller

[11] 4,365,796

[45] Dec. 28, 1982

[54] TICKET EXIT DRIVE MODULE

[75] Inventor: Gregory E. Miller, Escondido, Calif.

[73] Assignee: Cubic Western Data, San Diego, Calif.

[21] Appl. No.: 211,027

[22] Filed: Dec. 1, 1980

[51] Int. Cl.[3] ..... B65H 5/02

[52] U.S. Cl. ..... 271/274; 271/278; 232/8

[58] Field of Search ..... 271/3, 264, 265, 266, 271/272, 278, 273, 274; 250/223 R, 571; 221/277, 259, 307; 232/8

[56] References Cited

U.S. PATENT DOCUMENTS

| | | | |
|---|---|---|---|
| 2,253,311 | 8/1941 | Ward | 232/8 X |
| 3,287,013 | 11/1966 | Fairbanks | 271/272 X |
| 3,421,658 | 1/1969 | Cooksey | 221/307 |
| 3,531,625 | 9/1970 | Mizuta | 232/8 X |
| 3,791,516 | 2/1974 | Tramposch | 271/265 X |

*Primary Examiner*—Richard A. Schacher
*Attorney, Agent, or Firm*—Brown & Martin

[57] ABSTRACT

A ticket exit drive module for a ticket handling system includes a modular housing unit that is detachably mountable on a base or support plate adjacent to for mechanical interfacing with a transport unit or module of the system for receiving a ticket and passing the ticket along a ticket passage from its inlet to an outlet wherein the ticket is grasped between frictional fingers and held in position to be received by patron. Sensing means within the unit senses the presence and passage of a ticket therein.

10 Claims, 5 Drawing Figures

TICKET EXIT DRIVE MODULE

REFERENCE TO RELATED APPLICATIONS

The present application is directed to a modular unit that is part of a system covered by co-pending application entitled "Modularized Ticket Handling System For Use In Automatic Ticket Processing System" by John B. Roes et al and filed concurrently herewith.

BACKGROUND OF THE INVENTION

The present invention relates to handling systems for tickets and the like and pertains particularly to a ticket exit module for a ticket handling or processing system.

Tickets are used extensively throughout the world today for controlling the admission of patrons to entertainment and sporting events, and to transportation systems. Automated ticket handling systems are coming into widespread use throughout many areas of the world for these purposes. Such systems are useful in conjunction with patron control because it tends to reduce labor costs involved in the ticket handling and also reduces loss to theft and pilferage.

In order for such systems to be feasible, however, they must be highly reliable, durable and easily repaired. To this end it is desirable that the units be modular and easily and quickly removed from the system and replaced with a functional unit while the non-functioning unit is being either repaired or rebuilt.

Ticket handling units which dispense a ticket or the like to a patron should also have an outlet opening from which the ticket is dispensed that retains the ticket in position for the patron to grasp and also includes means preventing the insertion of foreign objects and articles into the ticket opening and to prevent other forms of vandals.

SUMMARY AND OBJECTS OF THE INVENTION

It is the primary object of the present invention to provide an improved ticket exit module for a ticket handling system.

In accordance with the primary aspect of the present invention, a ticket exit modular unit is adapted to be detachably positioned for interfacing with a ticket transport unit for receiving a ticket from the unit dispensing it to a position to be retrieved by patron. The unit is adapted to detachably fit into a mounting plate or panel and be quickly and easily removable and includes means for preventing the insertion of foreign objects into the ticket passage from the exit opening.

BRIEF DESCRIPTION OF THE DRAWINGS

The above and other objects and advantages of the invention will become apparent from the following description when read in conjunction with the drawings wherein.

DETAILED DESCRIPTION OF A PREFERRED EMBODIMENT

Figure 1:
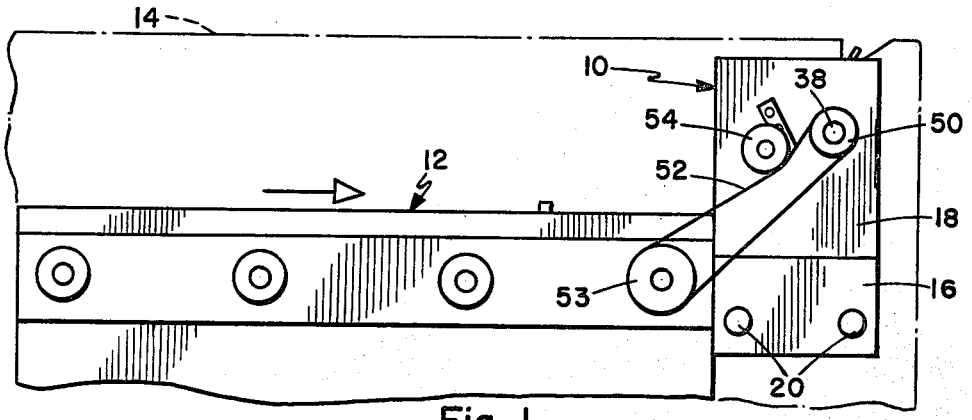
FIG. 1 is a side elevation view of an exit drive module coupled to a ticket transport unit.

Turning to FIG. 1 of the drawings there is illustrated a modular unit in accordance with the invention, designated generally by the number 10, mounted in close cooperative association and interfaced with a ticket transport unit 12, all of which is enclosed within a housing shown generally at 14. The transport unit 12 generally contains the primary processing functions for reading and otherwise handling or processing tickets and generating signals for opening gates and the like. The ticket, after processing is then returned to the patron at certain stations, such as an entry or exit gates. The ticket is normally inserted into the system, is verified as to the sufficiency thereof, the patron is then permitted to enter and then retrieve his ticket and proceed on his way. The exit unit returns the ticket to a position to be picked up by the patron after he has passed through the gate and the ticket has been processed through the transport module.

Figure 2:
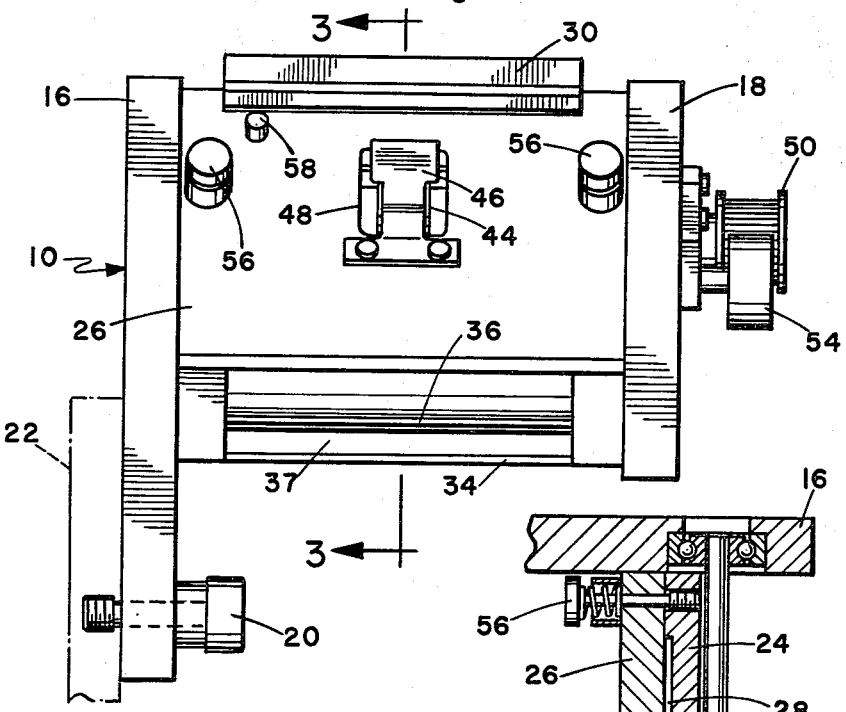
FIG. 2 is an enlarged view of the entry end of the exit drive module.
Figure 3:
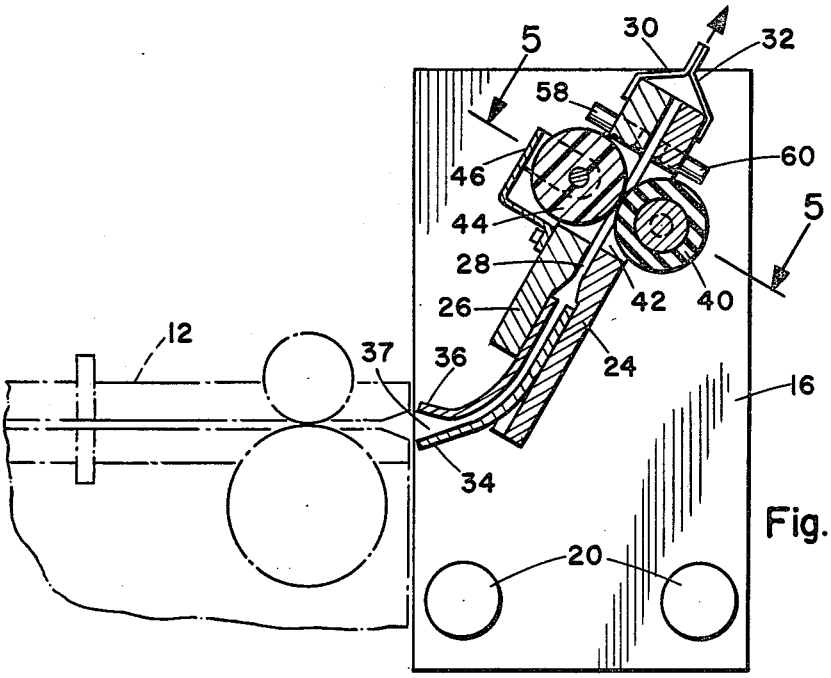
FIG. 3 is a sectional view taken on line 3—3 of FIG. 2.
Figure 4:
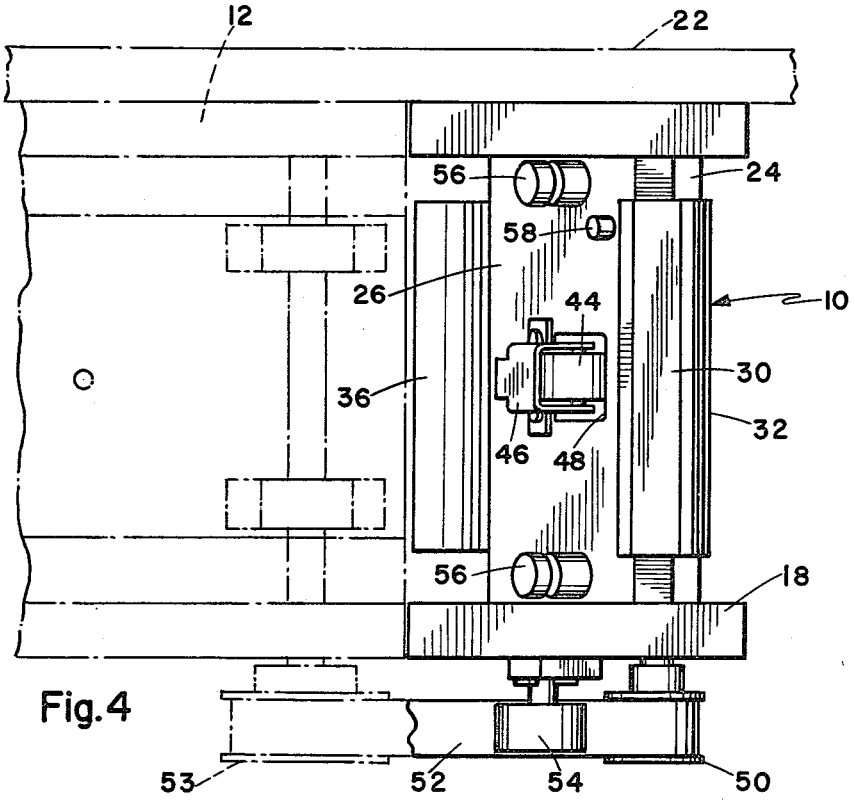
FIG. 4 is a top plan view of the module.

Turning to FIGS. 2 and 3, the exit module in accordance with the present invention comprises a pair of end plates consisting of an inner or base plate 16 and an outer plate 18. The base plate 16 includes one or more thumb screws 20 for quick detachable attachment to a mounting plate or panel 22 of the ticket processing system.

As best seen in FIG. 3, a pair of guide plates comprising a lower guide plate 24 and an upper guide plate 26 are secured together and disposed between the end plates 16 and 18 for defining the ticket passage. These plates are mounted at an upward angle as illustrated in FIG. 3, for transporting the ticket to an upper position along a ticket passage 28 to an upper exit end between a pair of gripping springs 30 and 32. These springs are leaf springs separately mounted on the upper and lower plates and biased together along opposed faces between which a ticket passes and is gripped and held for pick up by the patron. These spring members 30 and 32 also prevent the inserting of a ticket or other object into passage 28 from the exit end.

A pair of lower guide plates 34 and 36 are disposed at the inlet end of the ticket passage and include a generally V-shaped inlet 37 for mechanical interfacing with the outlet of the passage of the adjacent ticket transport unit for receiving a ticket therefrom and passing it through the exit module to the exit position.

Figure 5:
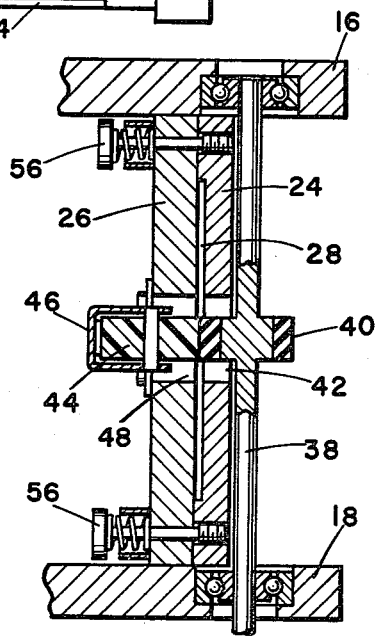
FIG. 5 is a sectional view taken on line 5—5 of FIG. 3.

Drive or transport means for transporting the ticket through the passage 28 of the exit module is best illustrated in FIG. 5 and comprises a drive shaft 38 rotatably mounted in bearings in the side plates 16 and 18 and carrying a drive wheel 40 which extends through a slot 42 in the lower plate 24 into the ticket passage. The drive roller 40 is engaged by a pinch roller 44 which is mounted on a spring bracket 46 and extends through a slot 48 in upper plate 26 into engagement with the roller 40 in the passage 28. The shaft 38 is driven by means of a pulley 50 mounted on the outer end thereof and driven by a belt or the like 52 from a pulley 53 on the adjacent transport unit 12, as seen in FIG. 1. An idler pulley 54 may be provided for maintaining tension in the belt 52.

The upper plate 26 is detachably mounted on top of the lower plate 24, in which the channel 28 is formed, by means of a pair of thumb screws 56, which include springs biasing the plate 26 to engagement with the plate 24. The upper plate is thus detachably mounted on the lower plate for quick removal thereof for removing of jammed tickets or the like from the ticket passage.

A sensing unit for sensing the presence and passage of the ticket through the passage 28 includes a light source unit such as a light emitting diode (LED) 58 for generating a light and a light sensing unit 60 for sensing the light and any interruption of the light from the light transmitting or sending unit 58.

The above described modular unit is therefore quickly and easily detachably mounted to a base mounting panel of a ticket processing and handling system adjacent to and in mechanical interfacing cooperation with an adjacent ticket transport unit for receiving tickets from the transport unit and presenting in a position at the exit between the gripping figures or springs 30 or 32 for retrieval and removal by a patron. Thus the unit serves to return the process ticket to the patron upon entrance or exit from a gate. The fingers 30 and 32 also function to prevent the insertion of tickets or the like into the passage 28 from the exit end thereof. The unit is driven or the drive transport portion is driven from the adjacent ticket transport unit by common drive means. Thus the systems are synchronized for cooperative driving and transport of a ticket through the passage thereof.

Thus, from the above description it is seen that I have provided an improved ticket exit module for presenting a ticket to the exit position for returning it to a patron which unit can be quickly and easily removed and serviced or replaced as required.

I claim:

1. A ticket exit drive module for detachably mounting as a unit in interfacing cooperation with a transport module in a ticket processing system, said module comprising:

housing means defining a ticket passage having an inlet for interfacing with and receiving a ticket from an adjacent transport module and an exit for returning a ticket to a patron, said housing including an upper guide plate and a lower guide plate cooperatively defining said ticket passage, a pair of vertically disposed end plates supporting said guide plates therebetween, one of said end plates including mounting means for detachable mounting on a vertical support panel, and drive means extending into said passage for engaging and driving a ticket along said ticket passage.

2. The exit module of claim 1 including an inlet guide chute having a V-shaped inlet opening for receiving and guiding a ticket from an adjacent transport module into said passage.

3. The exit module of claim 2 wherein said drive means comprises a drive shaft rotatably mounted in said end plates and including a drive roller extending through an opening in said lower plate into said passage, and pinch roller means extending through said upper guide plate and biased into engagement with said guide roller in said passage.

4. The exit module of claim 3 including ticket sensing means at said exit for sensing a ticket in said passage.

5. The exit module of claim 3 including gripping means at said exit for gripping a ticket extending from said exit and for preventing the insertion of objects into said ticket passage via said exit.

6. The exit module of claim 5 wherein said gripping means comprises a pair of opposed leaf springs biased together along opposed faces aligned with said passage through which a ticket passes.

7. The exit module of claim 6 wherein said ticket passage extends upward at an angle to the horizontal to the exit.

8. The exit module of claim 3 wherein:

said lower plate includes a channel in the upper surface thereof defining the depth of said channel; and a pair of thumb screws detachably securing said upper plate directly to said lower plate.

9. The exit module of claim 8 including spring means carried by said thumb screws for biasing said upper plate toward said lower plate.

10. The exit module of claim 9 wherein said mounting means comprises a pair of spaced apart thumb screws carried by said one of said end plates for threadably engaging threaded bores in said vertical support panel.

* * * * *